US005248987A

United States Patent [19]

Lee

[11] Patent Number: 5,248,987

[45] Date of Patent: Sep. 28, 1993

[54] WIDEBEAM ANTENNA

[75] Inventor: Joseph C. Lee, Lexington, Mass.

[73] Assignee: Massachusetts Institute of Technology, Cambridge, Mass.

[21] Appl. No.: 816,325

[22] Filed: Dec. 31, 1991

[51] Int. Cl.[5] ..... H01Q 13/00

[52] U.S. Cl. ..... 343/785; 343/772; 343/786

[58] Field of Search ..... 343/785, 789, 784, 772, 343/786, 783, 784

[56] References Cited

U.S. PATENT DOCUMENTS

| | | | |
|---|---|---|---|
| 3,389,394 | 6/1968 | Lewis | 343/785 |
| 4,468,672 | 8/1984 | Dragone | 343/783 |
| 4,673,945 | 6/1987 | Syrigos | 343/785 |
| 4,673,947 | 6/1987 | Newham | 343/785 |

FOREIGN PATENT DOCUMENTS

| | | | |
|---|---|---|---|
| 0867356 | 5/1969 | United Kingdom | 343/785 |

OTHER PUBLICATIONS

E. A. Lee and Y. M. Hwang, "An EHF Omnidirectional Lens Antenna", IEEE 1989, pp. 1610-1613.

John D. Krauss, "Antenna", Second Edition, Date is not given, Contents only.

F. Baldissar and L. A. Alfredson, "A Ku-Band Antenna for Spacecraft Telemetry and Command", IEEE 1984, pp. 155-157.

*Primary Examiner*—Donald T. Hajec

*Assistant Examiner*—Tan Ho

*Attorney, Agent, or Firm*—Choate, Hall & Stewart

[57] ABSTRACT

The widebeam antenna includes a tapered dielectric waveguide having a radiating end and an end for coupling electromagnetic energy into and out of the dielectric waveguide. A conducting sleeve surrounds the dielectric waveguide. A corrugated flange surrounds the sleeve near the radiating end of the waveguide and a dielectric ring also surrounds the radiating end of the waveguide. It is preferred that the dielectric ring have a dielectric constant in the range of 2.0 to 4.0. The structure of the invention provides substantially uniform hemispherical coverage for the transmission and reception of electromagnetic energy.

21 Claims, 3 Drawing Sheets

WIDEBEAM ANTENNA

This invention was made with government support under Contract Number F19628-90-C-0002 awarded by the Air Force. The government has certain rights in the invention.

BACKGROUND OF THE INVENTION

Widebeam antennas are used extensively in military and commercial consumer low-power applications. In general, they may consist of a dielectric waveguide opening with specially shaped conducting and dielectric boundary conditions. The radiating modes of the waveguide determine the far field radiation pattern of the antenna, which, for simple geometries, can be calculated via a Kirchoff diffraction integral. The theory of waveguide antennas is reviewed in Kraus, J., "Antennas" Second Edition, McGraw Hill, 1975.

One outstanding problem in the design of waveguide antennas has been the achievement of uniform hemispherical spatial coverage, while maintaining small size and low weight. More specifically, a circularly polarized, axially symmetric beam radiator is required in the microwave and millimeter wave frequency range. Some examples might be telemetry, tracking and command antennas used in connection with a satellite or a flying drone, antennas for aircraft microwave landing systems, SOS rescue, GPS (Global Positioning System) navigation, and compact efficient feeds for circular aperture antennas.

In the low frequency range, cross-dipoles, conical spirals and arrays of diffracting slots have been used to achieve widebeam radiation with some success. Such structures are not adaptable to the microwave and millimeter wave regimes because of structure complexity, tight fabrication tolerances and high losses.

Alternatively, at quasi-optical frequencies, approaches to the design of widebeam radiators have focused on divergent lenses and reflectors, which yield antennas too large and heavy for many of the applications mentioned. See, E. A. Lee and Y. M. Hwang, "An EHF Omnidirectional Lens Antenna", IEEE AP-S International Symposium 1989, p. 1610.

In the microwave and millimeter wave regimes, one approach to achieving hemispherical widebeam coverage is to taper the opening of the waveguide and simultaneously to control the cutoff frequency of the waveguide using a dielectric loading element. This approach usually yields narrow bandwidth and asymmetry in the radiation pattern.

Improved techniques proposed in conjunction with or in lieu of waveguide opening reduction include parasitic probes, U.S. Pat. No. 3,778,838, multiple cross dipoles and parasitic radiators suspended in front of the waveguide opening and a conical ground plane. See F. Boldissar and L. A. Alfredson, "A Ku-band Antenna for Spacecraft telemetry and Command", IEEE Antennas and Propagation Symposium, June 1984, p. 155 and A. Kumar, "Hemispherical Coverage Antenna for Spacecraft", Electronic Letters, 1988, p. 631. These approaches yield complicated antenna structures with rigid constraints on tolerance.

Finally, we are aware of an effort to achieve a broadbeam hemispherical uniform radiating structure in the X band using a specifically configured dielectric plug. See, E. G. A. Goodall, "Hemi-isotropic Radiators for the S- or X-band", Proc. IEE, 1959, p. 318 and E. G. A. Goodall, "Improvements In or Relating to Very Short Wave Aerials", British Patent No. 808,941, 1959. The resulting design is limited to linear polarization and exhibits an asymmetrical radiation pattern.

A fundamental challenge in all waveguide widebeam antenna designs is to achieve uniformity of coverage over a hemisphere via relatively uncomplicated radiating elements with a full polarization diversity.

SUMMARY OF THE INVENTION

The widebeam antenna of the invention includes a tapered dielectric loaded waveguide having a radiating end closely coupling electromagnetic energy into a dielectric ring resonator. A conducting corrugated flange surrounds the waveguide near the radiating end. In a preferred embodiment, the corrugated flange is spaced apart from the dielectric ring and the flange includes two annular corrugations. It is preferred that the dielectric ring have a dielectric constant in the range of 2.0 to 4.0. Suitable materials for the dielectric ring are cross linked polystyrene, fused quartz, boron nitride, polytetrafluoroethylene, polystyrene, polyethylene and polymethylpentene. In this embodiment, the waveguide conducting tube and dielectric ring have circular cross-sections.

The novel radiating structure of the invention provides substantially uniform hemispherical coverage for the transmission and reception of electromagnetic energy. The antenna is capable of transmitting and receiving electromagnetic energy of arbitrary polarization.

In another embodiment, two of the radiating structures are combined to provide substantially uniform spherical coverage with a polarization which is determined by an internal polarizer. Two hemispherical coverage radiators are mounted on a common conductor sleeve and fed by any conventional method of coupling energy to an antenna such as a probe and a directional coupler.

The present antenna design provides substantially uniform hemispherical coverage in a configuration of small size and low weight.

DESCRIPTION OF THE PREFERRED EMBODIMENT

First of all, we will review the basic operating principles of widebeam waveguide antennas. We note that the theory of waveguide antennas is covered in classical electromagnetics textbooks. A waveguide antenna consists of a dielectric waveguide of rectangular or circular cross-section (depending on the desired frequency range) in which the electromagnetic energy is fed via some means such as a probe attached to the nonradiating end. The radiating end is coupled to free space by some dielectric structure. The radiating modes of the dielectric waveguide will therefore constitute the waveguide antenna radiation pattern. A waveguide antenna designer can achieve a desired far-field radiation pattern by choosing the radiating modes of the waveguide; he implements this choice by selecting a dielectric material of a particular dielectric function and structure. At the same time the designer must cope with the requirement that the radiated modes of the waveguide should couple with minimal losses to an electromagnetic wave in free space.

Figure 1:
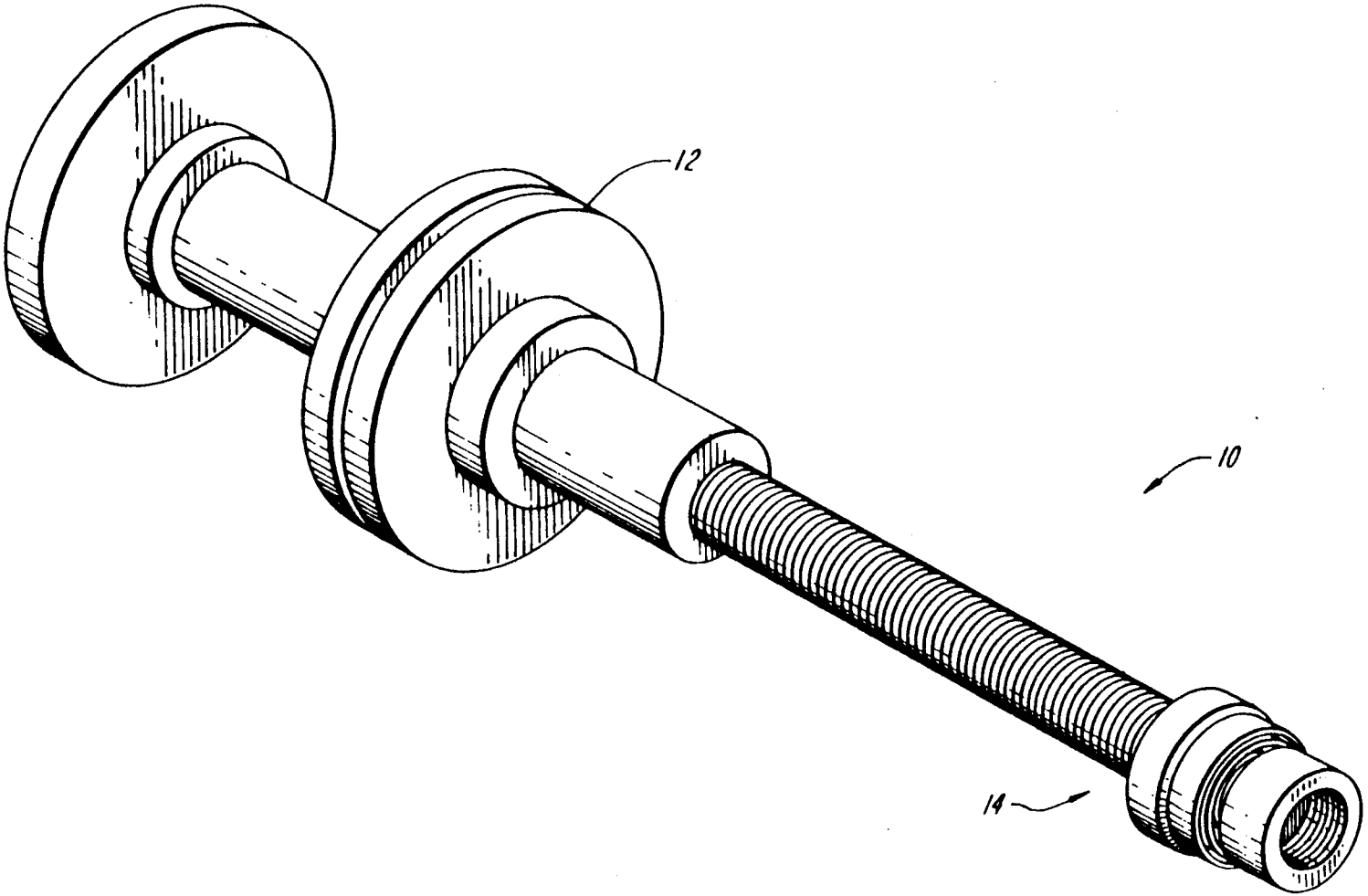
FIG. 1 is a perspective view of one embodiment of the invention.
Figure 2:
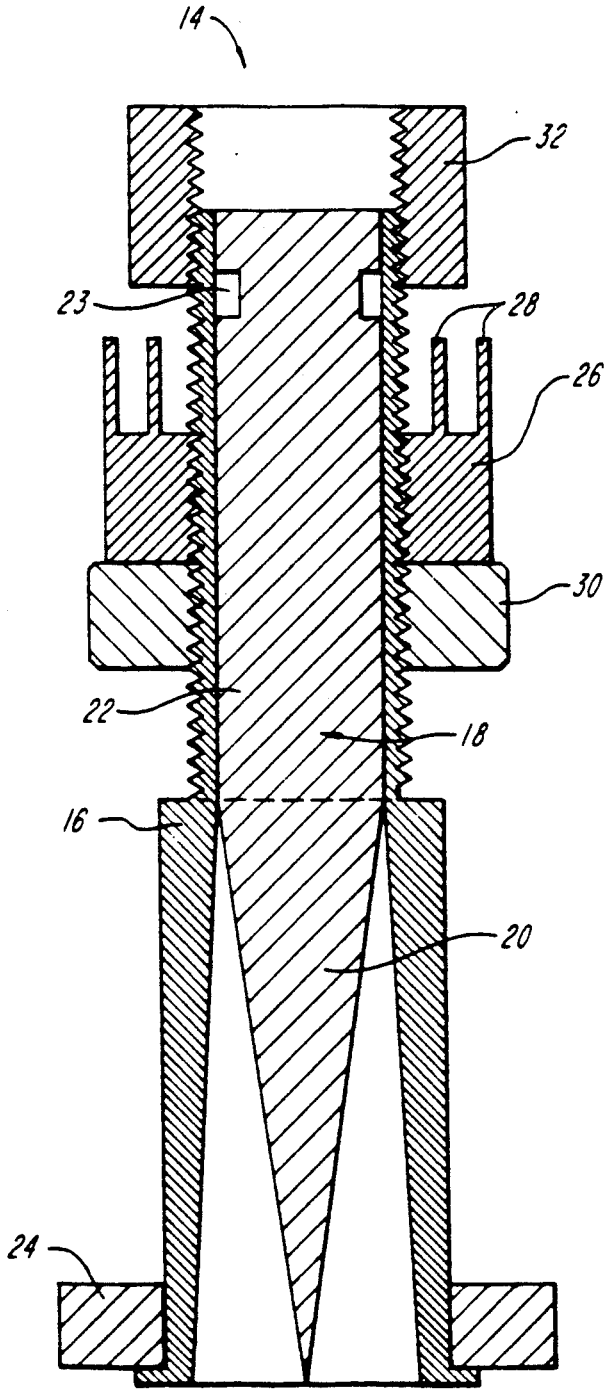
FIG. 2 is a cross-sectional view of a waveguide antenna of the invention.

With reference to FIG. 1, a widebeam antenna 10 is adapted to provide uniform hemispherical spatial coverage for the transmission and reception of electromagnetic waves. Electromagnetic energy is coupled into or out of the antenna 10 at a coupling 12. A radiating end 14 of the widebeam antenna 10 is shown in cross-section in FIG. 2. With reference both to FIGS. 1 and 2, the radiating end 14 of the waveguide antenna 10 includes a tapered conducting tube 16 made of, for example, copper having an inner diameter which decreases from a first diameter at an opposite end opposite the radiating end 14 to a second diameter at a point between the radiating and opposite ends, and having a constant outer diameter from the opposite end to the point between the radiating and opposite ends, and surrounding a dielectric loaded waveguide 18 having a tapered section 20 and a cylindrical portion 22. An annular notch 23 in the cylindrical portion 22 may be provided for impedence matching. A flange 24 is soft soldered to the conducting sleeve 16. The flange 24 is provided for coupling the radiating end 14 of the waveguide antenna 10 to a source of electromagnetic radiation.

The widebeam antenna includes a corrugated flange 26 including annular projections 28. The corrugated flange 26 is conducting and may be made, for example, of aluminum. The flange 26 is threaded to mate with threads on the conducting tube 16. The flange 26 is held in place by means of locking nut 30. The dielectric waveguide 18 at its radiating end is coupled to a circular dielectric ring 32. To ensure that electromagnetic waves in the resonating dielectric ring 32 couple efficiently to free space, the dielectric material should have a dielectric constant in the range of 2.0 to 4.0. Suitable materials for the dielectric ring 32 are cross-linked polystyrene, fused quartz, boron nitride, polytetrafluoroethylene, polystyrene, polyethylene or polymethylpentene. It should be noted that the dielectric ring 32 need not be a separate piece but may be integral with the waveguide 18. It should also be recognized that the cross section of the waveguide antenna disclosed herein may be a triangle, square or other regular polygon instead of the circular cross section illustrated herein.

In a preferred embodiment, the radiating end 14 of the widebeam antenna 10 is a tapered waveguide loaded by a dielectric ring of Rexolite and fed by a circular waveguide. In this embodiment, the active part of the radiating end 14 is approximately two inches long. The annular projections 28 are approximately 0.4 $\lambda_0$ from the end of the tube 16 and are separated from the dielectric ring 32 by approximately 0.2 $\lambda_0$ where $\lambda_0$ is the center frequency wavelength of the electromagnetic radiation. The corrugation depth is about 0.3 $\lambda_0$. The outer and inner diameters of the dielectric ring 32 are about 1 and 0.5 $\lambda_0$ respectively. The length of the ring 32 is about 0.5 $\lambda_0$. The internal diameter of the sleeve 16 at the location of the flange 24 is approximately 0.7 $\lambda_0$. Antenna dimensions exactly scale with frequency of the radiation.

Figure 3:
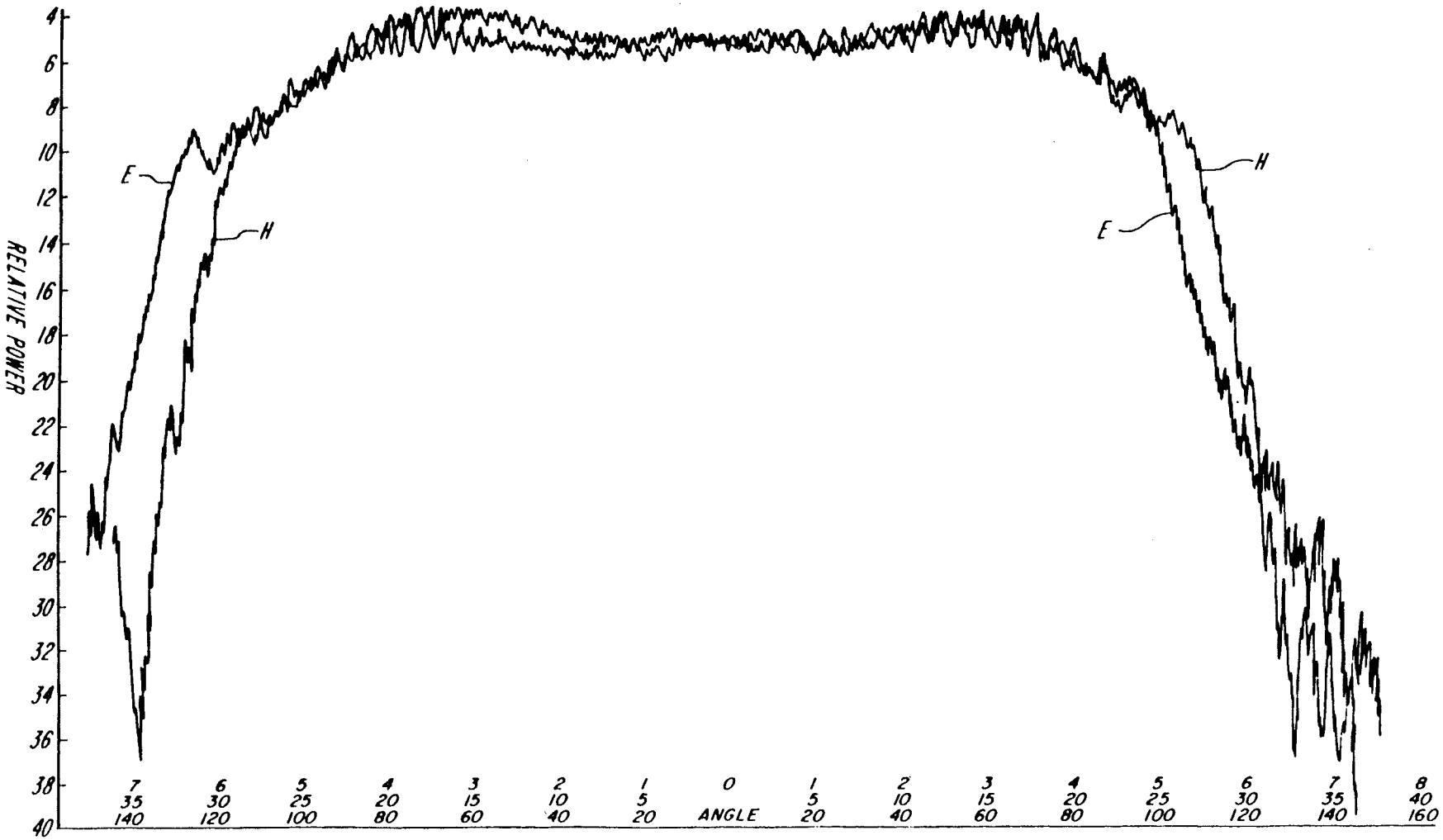
FIG. 3 is a graph of the radiation pattern of the widebeam antenna of the invention at 32 GHz.

FIG. 3 illustrates the substantially uniform hemispherical coverage of the wideband antenna made according to the invention. The E- and H-plane patterns shown in FIG. 3 were measured at 32 GHz. Similar results were obtained over about a 20% bandwidth. The graphs demonstrate that a simple radiator with a very wide and axially symmetric beam pattern has been achieved. The Ka-band patterns shown in FIG. 3 are linerally polarized, but the close match of the E- and H-plane patterns indicates that, with the addition of a polarizer, a very low axial ratio is achievable. It should be noted that a pair of the antenna structures disclosed herein may be arranged in a back-to-back configuration to achieve a substantially uniform spherical far-field pattern.

The graphs of FIG. 3 were made using a test model built for Ka-band as shown in FIG. 1. The test model, including the rectangular to circular waveguide transition, has a total length of about 5 inches which was chosen for easy adjustment. For a final model, this length can be greatly reduced. The estimated length of a 44-GHz model is less than 2 inches. The test dielectric material is Rexolite. Tests show that low loss materials with dielectric constants in the range of 2.0 to 4.0 work well with some adjustment of ring dimensions. This range of dielectric constant spans the best behaving (low loss, wide frequency band, etc.) dielectrics including Rexolite, fused quarts, and boron nitride.

What is claimed is:

1. Widebeam antenna comprising:

a tapered dielectric waveguide having a radiating end;

a conducting tube surrounding the dielectric waveguide, the conducting tube having an inner diameter which decreases from a first diameter at an opposite end opposite the radiating end to a second diameter, less than the first diameter, at a point between the radiating and opposite ends, and having a constant outer diameter from said opposite end to said point;

a conducting corrugated flange surrounding the tube near the radiating end of the waveguide, one side of the flange nearest the radiating end of the waveguide comprising a plurality of corrugations oriented parallel to a longitudinal axis of the waveguide between the radiating and opposite ends; and a dielectric ring surrounding the tube at the radiating end of the waveguide.

2. The antenna of claim 1 wherein the corrugated flange includes two annular corrugations.

3. The antenna of claim 2 wherein the annular corrugations have a depth of approximately 0.3 $\lambda_0$.

4. The antenna of claim 1 having a circular cross-section.

5. The antenna of claim 4 wherein the conducting tube includes an outer surface upon which is disposed mechanical threads, and wherein the corrugated flange and the dielectric ring each includes an inner surface adjacent the conducting tube, mechanical threads being disposed upon each inner surface in an orientation such that the dielectric ring and the corrugated flange may each be screwed on to the conducting tube so that the flange and ring threads engage the conducting tube threads to mechanically secure the corrugated flange and dielectric ring along the length of the conducting tube.

6. The antenna of claim 1 wherein the dielectric ring has a dielectric constant in the range of 2.0 to 4.0.

7. The antenna of claim 1 wherein the dielectric ring is made of cross-linked polystyrene.

8. The antenna of claim 1 wherein the dielectric ring is made of boron nitride.

9. The antenna of claim 1 wherein the dielectric ring is made of fused quartz.

10. The antenna of claim 1 wherein electromagnetic radiation is polarized before entering the antenna.

11. The antenna of claim 1 wherein the corrugated flange is spaced apart from the dielectric ring.

12. The antenna of claim 1 wherein a portion of the dielectric ring extends beyond the end of the conducting tube.

13. The antenna of claim 1 wherein the dielectric ring is made of polytetrafluoroethylene.

14. The antenna of claim 1 wherein the dielectric ring is made of polystyrene.

15. The antenna of claim 1 wherein the dielectric ring is made of polyethylene.

16. The antenna of claim 1 wherein the dielectric ring is made of polymethylpentene.

17. The antenna of claim 1 wherein the dielectric ring has an outer diameter of approximately $\lambda_0$ and an inner diameter of approximately 0.5 $\lambda_0$ and a length of approximately 0.5 $\lambda_0$ where $\lambda_0$ is the center frequency wavelength of the electromagnetic radiation.

18. The antenna of claim 1 wherein the corrugated flange and dielectric ring are separated by approximately 0.2 $\lambda_0$.

19. The antenna of claim 1 wherein the dielectric waveguide and dielectric ring are a single piece.

20. The antenna of claim 1 having a regular polygon cross section.

21. The antenna of claim 1 wherein the tapered dielectric waveguide comprises a column of dielectric material tapered from a first width at an end opposite the radiating end to a second width, greater than the first width, at a point between the radiating and opposite ends.

* * * * *